US005682961A

United States Patent [19]

Sotomayor et al.

[11] Patent Number: 5,682,961

[45] Date of Patent: Nov. 4, 1997

[54] SKYRISE WINDOW PANEL INSTALLATION ASSEMBLY

[76] Inventors: Francisco Sotomayor, 411 SW. 68th Blvd., Pembroke Pines, Fla. 33023; Rodolfo Charry, 118 SW. 159th Way, Sunrise, Fla. 33026

[21] Appl. No.: 699,949

[22] Filed: Aug. 20, 1996

[51] Int. Cl.[6] ..... E04G 3/16

[52] U.S. Cl. ..... 182/142; 182/133

[58] Field of Search ..... 182/133, 142

[56] References Cited

FOREIGN PATENT DOCUMENTS 1341538 9/1963 France ..... 182/142

*Primary Examiner*—Leslie A. Braun
*Assistant Examiner*—Long Dinh Phan
*Attorney, Agent, or Firm*—Malloy & Malloy, P.A.

[57] ABSTRACT

A skyrise window panel installation assembly including an heavy duty cable structured to extend down a side of a skyrise and be securely anchored at a point above an installation location. The assembly further includes a winch assembly having a rigid and strong drive frame at which the cable is received and securely engaged for secure guided, driven interconnection, selectively up and down a length of the cable, thereby providing for the effective positioning of the winch assembly in a desired position relative to the window panel installation location. Secured to the drive frame is a primary operator chair wherein a primary operator sits in confronting relation to the side of the skyrise in order to effectively and precisely position the winch assembly in the desired position. Extending from the drive frame is a connection bracket, to which a suction assembly is secured. The suction assembly includes a mount frame and is disposed in a generally vertically disposed orientation along the side of the skyrise. Moreover, secured to the mount frame is at least one suction grip which is capable of securely, yet selectively engaging a face of the window panel so as to retain it in a generally vertically disposed orientation along the side of the skyrise. So as to facilitate positioning of the window panel into the installation location, the installation assembly further includes a secondary operator support whereon a secondary operator is maneuverably and adjustably positioned.

18 Claims, 3 Drawing Sheets

15
20
45
92
10
89
70
28
70
60
64
67
62
66
69
65
49
68
70
70

SKYRISE WINDOW PANEL INSTALLATION ASSEMBLY

BACKGROUND OF THE INVENTION

1. Field of the Invention

The present invention relates to a skyrise window panel installation assembly which is to be effectively and efficiently implemented on a variety of building configurations in order to provide for the safe, rapid, and cost effective removal and/or installation of large window panels utilizing a compact, adaptable, highly maneuverable and more easily transportable assembly that requires fewer operators than have been traditionally required to achieve safe and complete installation and/or removal.

2. Description of the Related Art

Many buildings, and especially tall, skyrise-type office buildings include large window panels, or other large material panels secured to an exterior thereof. Due to the substantial elevation at which the installation in the building must usually take place, and due to the large size of the panels themselves, however, actual removal and/or installation of the window panels can be a very costly, time consuming and arduous task.

Specifically due to the large size of most conventional window panels, installation of the panels must be achieved by raising or lowering the window panel to the installation location along an exterior of the building. Presently, to achieve the exterior installation of the window panels, conventional motorized outrigger platforms and scaffolding are utilized to position workers and materials at or near the installation location. Unfortunately, however, even though such platforms and scaffolding are generally safe and effective for other duties, such as painting or washing windows, the substantially large, cumbersome size of most common window panels makes the normal use of such assemblies quite dangerous and requires costly added measures be taken to aid in the installation.

In a normal situation, when a window panel is broken, and/or a new window panel must otherwise be installed, the large window panels are generally raised from the ground on a long, outrigger type, painters' platform. Specifically, the painters' platform is generally suspended at opposite ends thereof by individual wires connected with multiple winches disposed on the roof of the building. The winches, functioning in unison with individual operators manning their respective controls, are able to raise and lower the painters' platform to the appropriate height. Further, since the painter's platform has an open upper end, with only a hand rail enclosing the support surface, the tall elongate window panels are commonly stood up on the support surface for subsequent maneuvering to the appropriate installation location. Due, however, to the cumbersome nature of the window panels, and their susceptibility to tipping, especially under windy conditions or if excessive amounts of the window panel over hang the hand rail, it is often quite difficult and quite unsafe to effectively raise the large window panel on the single, conventional painters' platform. Furthermore, because one worker must be at each side of the platform manning winch controls and monitoring the other side to ensure the platform remains level, at least one or more additional workers are often necessary on the platform to stabilize the window panel. Of course, the inclusion of additional workers on the single platform raises questions of safety and excess weight.

As such, a more common technique that is presently utilized incorporates two of the painter's platforms suspended one atop another. The platforms are disposed such that workers on a first, lower platform, may hold a bottom of the window panel, and workers on the second, upper platform, may hold a top of the window panel, thereby seeking to maintain some stability over the window panel as it is maneuvered into installation position. When utilizing such a technique, however, both platforms must be raised and lowered in substantially precise unison, and at least four workers are required to man the controls of both platforms and maintain watch over the window panel. Additionally, if either of the platforms sway or move relative to one another, it can easily result in breakage, tipping, or an unbalancing of the window panel being raised. Additionally, even once the window panel has been lowered to an appropriate installation location, all the workers must function together to lift the window panel over the hand rail and off of the platform, handing it to an additional worker disposed inside the building and structured to guide the window panel into the appropriate mounted orientation. As a result, it is evident that the conventional techniques employed for installing the large window panels are not ideal or efficient to utilize, and can be quite expensive to effectively implement.

In addition to the large numbers of workers required, and the difficulty in effectively maneuvering and positioning the large window panel in place without breaking or tipping in a normal mounting location, more significant complications arise when mounting at or near the corner of a particular skyrise is required. Specifically, due to the elongate, flat nature of the painter's platforms utilized for the installation, and the requirement that a winch or cable be connected to the platform at both opposite ends thereof, it is generally not possible to hang such a platform directly at or very near the corner of a building. As a result, when the window panel is lowered to the general vicinity of a corner or edge window, the window panel must be precariously maneuvered and extended out towards the receiving area, a requirement that can lead to substantially unbalancing the platform and necessitates that the window panel itself be suspended in a less than ideal manner.

Moreover, yet another drawback associated with conventionally implemented assemblies regards the manner in which they are secured to the roof. Specifically, many platform assemblies, if they are not mounted as part of a permanent outrigger structure, require that large hooks or like fastening elements be secured to the facade of the building at a location at which the platform will be raised and lowered. Alternatively, the cables can be secured to a rigid structure directly on the roof of the building. While such techniques are generally safe and secure to support a platform from most conventional type buildings, many modern buildings are being constructed with extended facades which define a uniform exterior appearance up to the top edge of the building. Such extended facades, however, are often not a true structural component of the building and can be quite weak. Accordingly, it is not appropriate to secure the platform directly to the facade, and the only available technique to secure the platform to the building is to run the support cables over the edge/facade of the building and fasten them to a rigid support atop the building, if one is available. In such a configuration, however, the upper edge of the building over which the cables are run is susceptible to damage due to the weight of the cables and platforms resting on the non-structural element.

As a result, it would be highly beneficial to provide an improved skyrise window panel installation assembly which will minimize the number of workers required to safely and effectively remove and/or replace a large window panel.

Such an assembly should permit effective maneuverability by the workers in order to more efficiently locate the window panel within an appropriate opening, and should be safe and convenient to implement in a variety of building configurations, whether or not a solid facade is included, or whether or not sharp angles or corners are present and require the installation of window panels. Still, however, such a device should be substantially safe for use by the workers, and should permit total and complete control of the situation.

SUMMARY OF THE INVENTION

The present invention relates to a window panel installation assembly. Specifically, the window panel installation assembly includes at least one elongate heavy duty cable. That heavy duty cable is structured to extend down a side of the skyrise beyond the location at which a window panel is to be installed. Moreover, an end of the cable is secured at a point above the location at which the window panel is to be installed by anchorage means. Specifically, the anchorage means are structured to support a substantial weight, including a weight of the remainder of the installation assembly, the weight of the workers, and the weight of a window panel being supportably suspended by the installation assembly.

The installation assembly in the present invention further includes a winch assembly. In particular, the winch assembly includes cable engagement means. The cable engagement means are structured and disposed to receive the elongate, heavy duty cable therein for secure, guided, interconnection therebetween. As such, unless required the cable engagement means will maintain a fixed position relative to the cable. Specifically, so as to direct driven movement of the cable engagement means selectively up and down a length of the cable, the winch assembly further includes drive means. The drive means are structured to enable effective positioning of the entire winch assembly in a desired position relative to the location at which the window panel is to be installed.

The cable engagement means and the driving means of the winch assembly are structured to be mounted on a drive frame. Specifically, the drive frame is substantially rigid and strong, and provides for the effective, stable movement of all components of the winch assembly. Further secured to the drive frame is a primary operator chair. The primary operator chair is structured and disposed to permit a primary operator to effectively sit therein in confronting relation to the side of the skyrise. As a result, the primary operator is able to effectively and precisely operate the drive means in order to position the winch assembly in the desired position relative to the location at which the window panel is to be installed.

Extending from the drive frame of the winch assembly is a connection bracket. The connection bracket is structured to be securely interconnected with, and suspend a suction assembly. The suction assembly includes a mount frame and a connector segment. It is the connector segment of the suction assembly that is securely interconnected with the connection bracket of the winch assembly, thereby positioning the mount frame of the suction assembly in a generally vertically disposed orientation along the side of the skyrise. Further, secured to the mount frame of the suction assembly is at least one suction grip. The suction grip is structured to securely engage a face of the window panel with a strong, secure suction, and thereby retain the window panel in the generally vertically disposed orientation of the mount frame along the side of the skyrise.

Also included in the skyrise window panel installation assembly of the present invention is a secondary operator support. Specifically, the secondary operator support is structured to supportably position a second operator in a highly maneuverable and adjustable position relative to the suction assembly. As a result, the second operator is able to effectively and precisely maneuver and position the suction assembly, and the window panel retained thereby, into aligned, mounting relation with the location at which the window panel will be installed.

It is an object of the present invention to provide an improved skyrise window panel installation assembly which is substantially safe to operate and utilize to both remove a window panel and replace a large window panel within a skyrise.

Also an object of the present invention is to provide a skyrise window panel installation assembly which is highly maneuverable and adaptable to a variety of installation sites and locations including corners and edges of the building.

Another object of the present invention is to provide a skyrise window panel installation assembly which is able to dispose an operator in a freely maneuverable location to properly orient and position the window panel from outside the building.

Yet another object of the present invention is to provide a skyrise window panel installation assembly which does not require a dedicated outrigger assembly built onto the roof of the skyrise in order to be easily and effectively positioned and operated.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
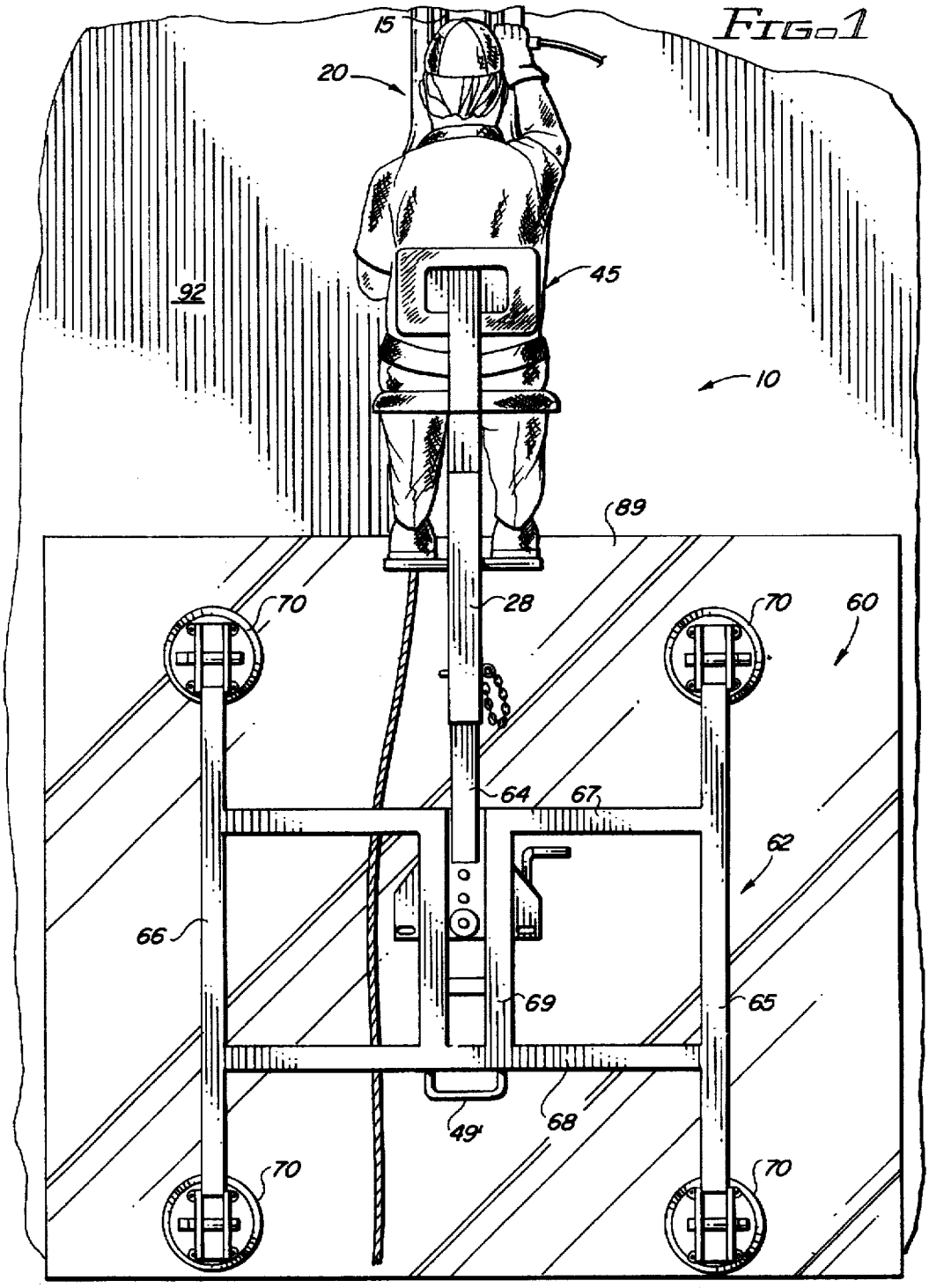
FIG. 1 is a rear view of the skyrise window panel installation assembly of the present invention.
Figure 2:
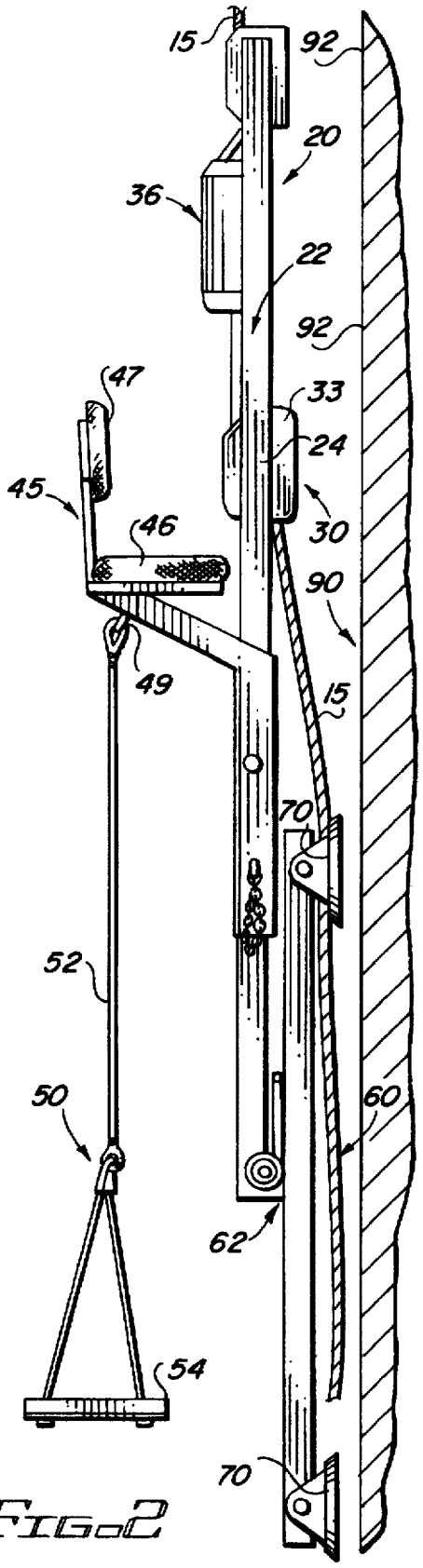
FIG. 2 is a side view of the skyrise window panel installation assembly of the present invention.
Figure 5:
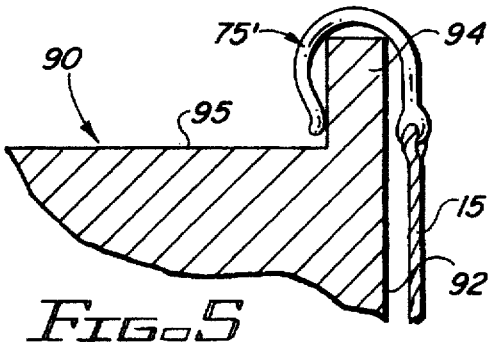
FIG. 5 is an isolated view of an embodiment of the anchorage means of the present invention.
Figure 6:
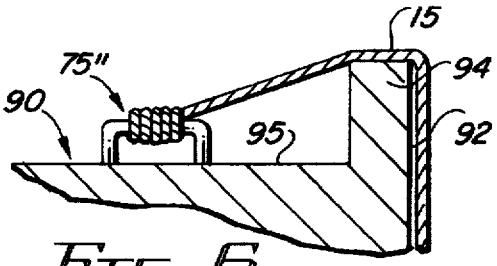
FIG. 6 is an isolated view of another embodiment of the anchorage means of the present invention.

Shown throughout the Figures, the present invention is directed towards a skyrise window panel installation assembly, generally indicated as 10. The installation assembly 10 is structured to facilitate the safe and cost effective positioning of a large window panel 89 at a specific installation location in a side 92 of a skyrise 90. Moreover, the installation is able to be achieved with only three workers, with substantially rapid setup time, and with substantially more effective maneuverability and manipulability of the window panel 89 as it is being positioned in the specific location within the skyrise 90.

In particular, the skyrise window panel installation assembly 10 includes at least one elongate, heavy duty cable 15. The heavy duty cable 15, which preferably includes a plurality of metal strands woven together in order to permit it to support a substantial weight without breakage, is structured to extend down the side 92 of the skyrise 90 beyond the location at which the window panel 89 is to be installed. Further, the heavy duty cable 15 is structured to be suspended alongside the skyrise 90 by anchorage means 75. The anchorage means 75, which will be described in greater detail subsequently, are structured to secure an end of the cable 15 at a point above the location at which the window panel 89 is to be installed, and preferably at or substantially near a roof 95 of the skyrise 90. Accordingly, in the preferred embodiment the heavy duty cable 15 will be structured to extend along an entire side 92 of the skyrise 90, from the roof 95 to the ground. Such orientation of the cable 15 thereby facilitates positioning of the window panel 89 at any location along a height of the skyrise, and further facilitates initial loading of the window panel 89, preferably at the ground directly beneath the location at which it will be installed.

Turning specifically to the Figures, the skyrise window panel installation assembly 10 of the present invention includes a winch assembly, generally 20. The winch assembly 20 includes a drive frame 22. The drive frame 22 is structured to be substantially rigid and strong as it will support a substantial portion of the installation assembly 10 into engagement with the cable 15. Preferably, the drive frame 22 is generally compact, including in the preferred embodiment a pair of spaced apart support members 24 and 25 spanned and secured with one another by a number of cross supports 26. It is preferred that the drive frame 22 be approximately the width of a normal individual so as to minimize the overall size and weight of the drive frame 22 and increase the maneuverability and adaptability of the drive frame 22.

Secured to the drive frame 22, and preferably at a central location such as on one of the cross supports 26, are cable engagement means 30. The cable engagement means 30 are structured and disposed to receive the cable 15 therein for secured guided interconnection therebetween. Specifically, the cable engagement means 30 preferably include a housing 33 wherein at least two gear elements 34 and 35 receive the cable 15 in wound, engaging relation therebetween. Preferably, one of the gear elements 35 is structured to receive the cable 15 wound thereabout, at least one time, in order to provide for some retention, and the other gear element 34, which may include a plurality of teeth or another gripper type surface, is disposed in close, spaced relation thereto so as to engage the cable 15 to prevent slippage thereof. As such, when upward or downward movement of the winch assembly 20 is desired, one or more of the gear elements 34 and 35 of the cable engagement means 30 will rotate to move the winch assembly 20 up and down a length of the cable 15. In a preferred embodiment, the cable engagement means are disposed on a rear of the drive frame 22, thereby maintaining the operation thereof isolated and away from an operator and other wires and cables which could potentially become entangled therewith.

In order to effectively direct driven movement of the cable engagement means 30 up and down a length of the cable 15, thereby effectively positioning the winch assembly 20 in a desired position relative to the location at which the window panel 89 is to be installed, the installation assembly 10 of the present invention further includes drive means 36. The drive means 36 are also preferably secured to the drive frame 22 to form part of the winch assembly 20. As illustrated in the Figures, in the preferred embodiment the drive means 36 includes a multi-directional motor 37, such as a conventional, powerful electric drill or like multi-directional motor, connected with at least one of the gear elements 34 and 35 of the cable engagement means 30, preferably through a gear box 38. In particular, the gear box 38 functions to translate the movement of the multi-directional motor 37 to direct and control corresponding movement of the gear elements 34, 35 of the cable engagement means 30, and thereby correspondingly move the cable engagement means 30, and the entire winch assembly 20 to which it is secured, up and down the length of the cable 15 in accordance with the direction of rotation of the motor 37. It is preferred that the drive means 36 be positioned on the front of the drive frame 22, thereby facilitating actuation thereof by an operator who will be disposed in substantially confronting relation thereto, as will be described. Moreover, although the motor 37 may be gas or battery powered, it is preferred that it be connected to an electrical power source, such as through an elongate power cord 39.

Also in the preferred embodiment of the installation assembly 10, the winch assembly 20 will further include an emergency brake assembly 40 secured to the drive frame 22 and structured to engage the cable 15 in order to prevent slippage thereof relative to the cable engagement means 30. In particular, as an added security element, the emergency brake assembly 40 will receive the cable 15 wound therethrough and is structured to be triggered upon sudden drops of the winch assembly 20 relative to the cable 15, which could indicate a slippage or other failure of the securement of the cable 15 by the cable engagement means 30. Accordingly, the emergency brake assembly 40 ensures that appropriate backup security measures are incorporated in the winch assembly 20 to ensure the safety of the operators and any individuals below the suspended positioning of the window panel 89.

Further included as part of the winch assembly 20 of the installation assembly 10, and preferably secured directly to the drive frame 20 is a primary operator chair 45. Specifically, the primary operator chair 45 is structured and disposed to permit a primary operator to effectively sit therein in a comfortable, confronting relation to the side 92 of the skyrise 90, and the drive means 36 which are also secured to the drive frame 22. As such, the primary operator chair 45 enables the primary operator to effectively and precisely position the winch assembly 20 in an appropriate position relative to the location at which the window panel 89 will be installed in a facilitated and highly accurate manner wherein they can view the installation location while raising or lowering the assembly. In order to achieve the effective and convenient positioning of the primary operator, the primary operator chair 45 is secured to the drive frame 22 by a generally elongate chair support 42. The chair support 42 extends away from the drive frame 22, thereby positioning the primary operator chair 45 in spaced apart, generally confronting relation with the drive frame 22. Also, as illustrated in the Figures, the primary operator chair 45 preferably includes a seat portion 46 and a seat back 47 in order to provide for more comfortable and stable securing of the primary operator. Additionally, a harness or other means to secure the primary operator either to the winch assembly 20, or via cable to an independent support secured to the skyrise 90 may also be incorporated. It is also seen, that with the primary operator chair 45 disposed in the spaced apart orientation as a result of the chair support 42, the primary operator is able to sit within the chair and project their legs beyond the drive frame 22, towards the side 92 of the skyrise 90. As a result, the primary operator can use their legs as a buffer to maintain the winch assembly 20 in an appropriately spaced apart relation from the side of the skyrise of the skyrise 90 as it descends or ascends the cable 15. Still, however, in an alternative embodiment, an independent buffer element such as a wheel or like element may be secured to the drive frame 22 in order to engage the side 92 of the skyrise 90 and maintain the winch assembly 20 in a generally spaced apart relation from the side 92 of the skyrise 90 during movement thereof.

Extending, from the drive frame 22 is a connection bracket 28. The connection bracket 28, which may be positioned such that the chair support 42, to which the primary operator chair 45 is secured also extends therefrom, extends generally downwardly from the drive frame 22 and effectively suspends a suction assembly, generally 60, directly beneath the winch assembly 20. Looking specifically to the suction assembly 60, it includes a mount frame 62. The mount frame 62 is configured of a secure, solid construction and is structured to securely engage the connection bracket 28 of the winch assembly 20, so as to dispose the suction assembly 60 in a generally vertically disposed orientation along the side 92 of the skyrise 90.

Preferably, the mount frame 62 of the suction assembly 60 has a generally H type configuration including a pair of vertical supports 65 and 66, along with a pair of horizontal support braces 67 and 68, thereby providing a secure, balanced configuration. Moreover, a central bracket 69 preferably spans the mount frame 62 and includes a hingedly secured connector arm 64. The hingedly secured connector arm 64 preferably extends from a precise center of the mount frame 62, thereby maintaining effective balance and maneuverability of the mount frame 62, and is structured to be adjustably interlocked with the connection bracket 28. In a preferred embodiment illustrated in the Figures, the connection bracket 28 is structured to receive the arm 64 therein for secure interconnection such as by a heavy duty pin or other effective, strong connection means. As a result, the suction assembly 60 is able to be adjustably and removably secured to the winch assembly 20 in order to correspond the specific window panel mounting needs of a given job. Moreover, multiple suction assemblies 60 may be included, and appropriately affixed to the window panel 89, thereby permitting the winch assembly 20 to be merely lowered and reconnected to a new, loaded suction assembly 60 when multiple windows must be secured in place.

Further included as part of the suction assembly 60 is at least one, but preferably more than one, suction grip 70. In the preferred embodiment, four of the suction grips 70 are disposed in a spaced apart relation from one another on the mount frame 62, at opposite corners of the mount frame 62, thereby ensuring a more effective engagement of a greater, more balanced area of the window panel 89. In particular, each of the suction grips 70 is structured to securely engage a face of the window panel 89 so as to retain the window panel 89 in the generally vertical disposed orientation in which the suction assembly 60 is disposed relative to the side 92 of the skyrise 90. Moreover, each of the suction grips 70 includes a large suction area which is positioned against the surface of the window panel 89 such that it may selectively engage and release the window panel 89. Further, specific actuation means are included to provide for the selective gripping and release of the suction grips 70 as desired. In the preferred embodiment the actuation means are remotely operable, such as by an elongate air or electrical switch which an operator can manipulate in order to release the suction grips 70 from the window panel 89 once the window panel 89 is effectively fitted into an appropriate location into the skyrise 90.

In order to facilitate the maneuverable and adjustable positioning of a second operator relative to the suction assembly 70, the installation assembly 10 of the present invention further includes a second operator support 50. In particular, the second operator support 50 suspends the second operator relative to the suction assembly 60 such that the second operator can effectively and precisely maneuver and position the suction assembly 60, and therefore the window panel 89 secured thereto, into aligned, mounting relation with the location at which the window panel 89 is to be installed. In a preferred embodiment, the secondary operator support 50 is removably secured to the winch assembly 20 by an elongate, generally flexible mount segment 52. As such, the second operator is able to move from side to side relative to the suction assembly 60 during mounting of the window panel 89. Moreover, so as to provide for some spacing to the secondary operator, the elongate, generally flexible mount segment 52 is preferably secured to a hook or clamp 49 secured on or near the primary operator chair 45. In an alternative embodiment, however, as illustrated in FIG. 1, the flexible mount segment may be shorter and may be secured to an auxiliary clamp 49' secured to the mount frame 62 of the suction assembly 60. Additionally, although the secondary operator support 50 may merely include a harness within which the secondary operator is secured, in a preferred environment, the secondary operator support 50 includes a seating platform 54 on which the second operator may sit during operation.

Accordingly, from the above structure it can be seen that a primary and secondary operators are raised, with the window panel 89 properly vertically oriented along the side 92 of the skyrise 90. Once the primary operator positions the installation assembly 10, utilizing the drive means 36, to an appropriate location wherein the window panel 89 is aligned with an installation opening, the secondary operator, disposed within the maneuverable secondary operator support 50, properly and effectively positions the window panel 89 in place, in many instances with the aid of only a single worker located inside the building. Once the window panel 89 is effectively positioned within the location and is secured in place through conventional means, the suction grips 70 are then released and the installation is completed. As such, only three workers are required to effectively install even the largest window panels 89.

Figure 7:
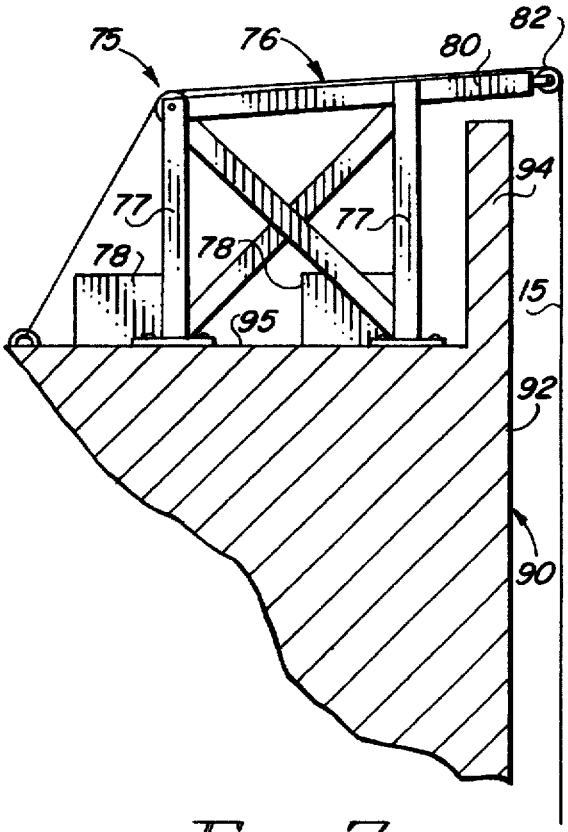
FIG. 7 is an isolated view of a preferred embodiment of the anchorage means of the present invention.
Figure 4:
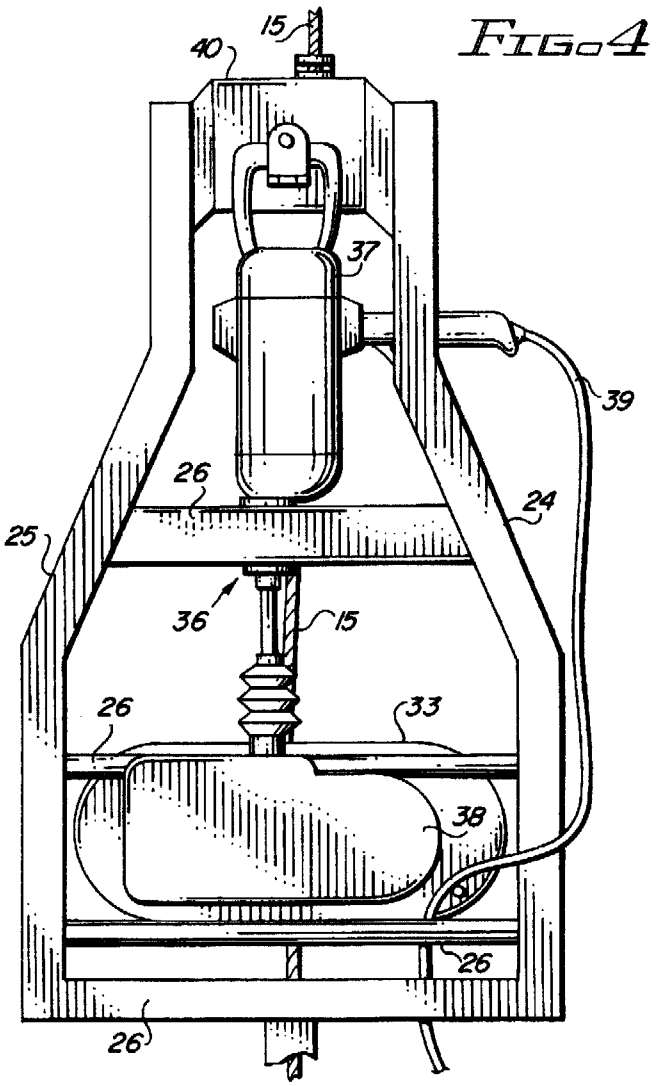
FIG. 4 is a front, isolated view of the winch assembly of the present invention.
Figure 3:
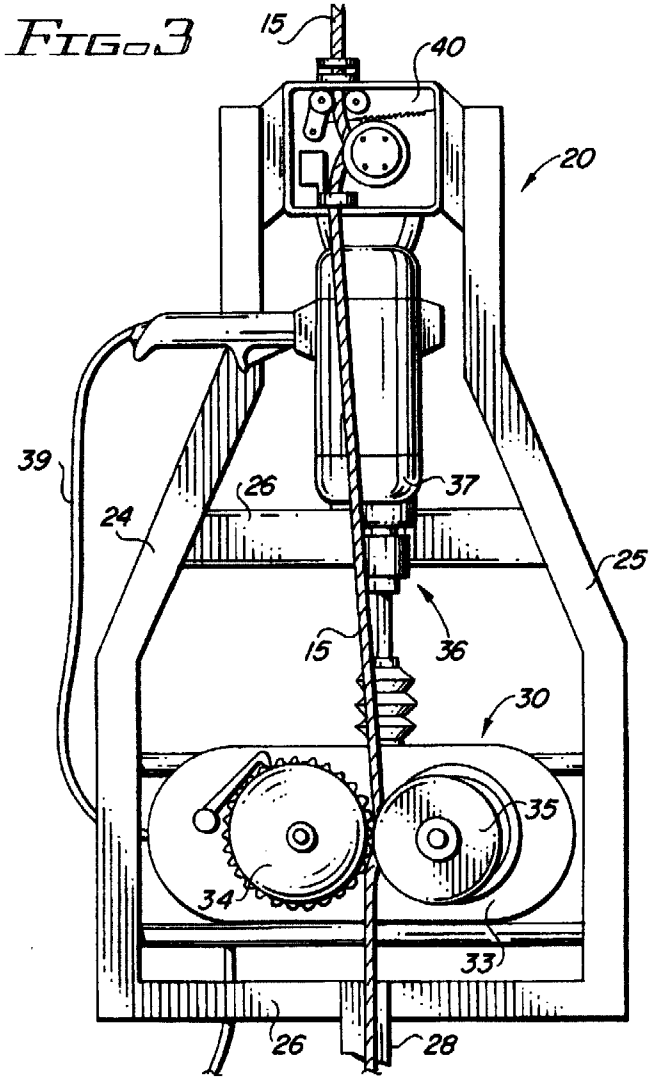
FIG. 3 is a rear, isolated view of the winch assembly of the present invention.

Looking once again to the anchorage means, in alternative embodiments the anchorage means may include a conventional type clamp assembly 75' structured to engage a facade 94 of the skyrise, or a mount bracket 75" secured to the skyrise 90, either at the facade 94 or to the roof 95 of the skyrise. In the preferred embodiment of FIG. 7, however, the anchorage means 75 include a scaffolding frame 76. In particular, the scaffolding frame 76 is of the type which includes a plurality of support stanchions 77 and a top end support 80 secured with one another. The top end support 80 of the scaffolding 76 is disposed to extend above an upper edge of the facade 94 of the skyrise 90 so as to define an extension segment that overhangs the facade of the skyrise 94 beyond the side 92 of the skyrise 90. It is the extension segment 80 that is configured to engage the cable 15 in order to ensure that the cable 15 extends downwardly along the side 92 of the skyrise 90 in generally spaced apart relation therefrom. Moreover, so as to provide for effective and appropriate positioning a pulley 82 or like bracket may be positioned at the end of the extension segment 80 for appropriate guiding of the cable 15. Additionally, if necessary, the cable 15 may be further secured to a mount bracket or other fixed fastening point on the skyrise 90.

Also, in order to prevent the scaffolding frame 76 of the anchorage means 75 from tipping towards the facade 94 of the building 90, upon the cable 15 supporting the weight of the winch assembly 20, the suction assembly 60, and the window panel 89, securing means are included. Although the securing means may include a number of strong lines anchored to a roof 95 of the skyrise 90, in the preferred embodiment, the securing means of the anchorage means 75 includes at least one, but preferably a plurality of counterweights 78, secured to the scaffolding frame 76. The counterweights 78 are structured and disposed to prevent tipping despite the maneuverability and manipulation of the installation assembly 10 along the side of the skyrise 90. Moreover, from this it can be seen that the scaffolding 76, which can be easily taken apart as with a normal scaffolding can be quickly and easily transported to, and erected on, a roof 95 of the skyrise 90 in a variety of locations, without requiring special adaptation or equipment on the roof 95 of the skyrise 90. Further, as the extension segment 80 is structured to extend over the facade 94, varying a length of the extension segment 80 can facilitate the positioning of the installation assembly 10 to function on a corner or oddly shaped edge of a skyrise 90. Such adaptability of the anchorage means 75 significantly expands the capabilities, and the rapid and effective operation of the installation assembly 10 of the present invention.

It should also be noted, that in the preferred embodiment both the primary and secondary operators will be independently harnessed and secured to safety lines. Those safety lines, each of which is preferably capable of withstanding 7500 lbs. of pressure are independently secured to a support atop the skyrise.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A skyrise window panel installation assembly comprising:

(a) at least one elongate, heavy duty cable, said cable being structured to extend down a side of a skyrise beyond a location at which a window panel is to be installed;

(b) anchorage means structured to secure an end of said cable at a point above the location at which the window panel is to be installed, said anchorage means being further structured to support a substantial weight;

(c) a winch assembly, said winch assembly comprising:

a drive frame, said drive frame being substantially rigid and strong, cable engagement means, said cable engagement means being structured and disposed to receive said cable therein for secure guided interconnection therebetween, drive means structured to direct driven movement of said cable engagement means selectively up and down a length of said cable so as to effectively position said winch assembly in a desired position relative to the location at which the window panel is to be installed, a primary operator chair, said primary operator chair being secured to said drive frame and being disposed so as to permit a primary operator to effectively sit therein in confronting relation to the side of the skyrise, thereby permitting the primary operator to effectively and precisely operate said drive means and position said winch assembly in the desired position relative to the location at which the window panel is to be installed, and a connection bracket secured to and extending from said drive frame;

(d) a suction assembly comprising:

a mount frame, said mount frame including a connector segment structured to securely engage said connection bracket of said winch assembly so as to dispose said suction assembly in a generally vertically disposed orientation along the side of the skyrise, and at least one suction grip secured to said mount frame, said suction grip being structured to securely engage a face of the window panel so as to retain the window panel in said generally vertically disposed orientation along the side of the skyrise; and (e) a secondary operator support, said secondary operator support being structured to supportably position a second operator in a maneuverable, adjustable position relative to said suction assembly, thereby permitting the second operator to effectively and precisely maneuver and position said suction assembly and the window panel retained thereby into aligned, mounting relation with the location at which the window panel is to be installed.

2. A skyrise window panel installation assembly as recited in claim 1 wherein said primary operator chair of said winch assembly includes a chair support secured to drive frame and structured to position said primary operator chair in spaced apart, generally confronting relation with said cable engagement means.

3. A skyrise window panel installation assembly as recited in claim 2 wherein said chair support which secures said primary operator chair to said drive frame is further structured to position said primary operator chair so as to permit the primary operator's legs to extend beyond said drive frame towards the side of the skyrise and thereby act as a buffer to maintain said winch assembly in an appropriately spaced apart relation from the side of the sky rise.

4. A skyrise window panel installation assembly as recited in claim 1 wherein said winch assembly further includes an emergency brake assembly structured to prevent slippage of said cable engagement means relative to said cable.

5. A skyrise window panel installation assembly as recited in claim 1 wherein said cable engagement means includes at least two gear elements structured to receive said cable in wound, engaging relation therebetween.

6. A skyrise window panel installation assembly as recited in claim 5 wherein said drive means includes a multidirectional motor connected with at least one of said gear elements of said cable engagement means and structured to effectively rotate said at least one of said gear elements in order to correspondingly move said cable engagement means and therefore said winch assembly up and down the length of the cable.

7. A skyrise window panel installation assembly as recited in claim 1 wherein said connection bracket extends downwardly from said drive frame so as to effectively suspend said suction assembly beneath said winch assembly.

8. A skyrise window panel installation assembly as recited in claim 1 wherein said suction assembly is removably secured to said winch assembly.

9. A skyrise window panel installation assembly as recited in claim 1 wherein said suction assembly includes at least two of said suction grips secured to said mount frame.

10. A skyrise window panel installation assembly as recited in claim 1 wherein said suction assembly includes four of said suction grips disposed in spaced apart relation from one another on said mount frame.

11. A skyrise window panel installation assembly as recited in claim 1 wherein said mount frame is movably secured with said connector segment so as to facilitate precise maneuvering and manipulation of the window panel retained by said suction assembly.

12. A skyrise window panel installation assembly as recited in claim 1 wherein said secondary operator support includes a seating platform on which the second operator sits.

13. A skyrise window panel installation assembly as recited in claim 1 wherein said secondary operator support is structured to be movably secured to said winch assembly by an elongate, generally flexible mount segment.

14. A skyrise window panel installation assembly as recited in claim 1 wherein said secondary operator support is structured to be movably secured to said suction assembly by a generally flexible mount segment.

15. A skyrise window panel installation assembly as recited in claim 1 wherein said anchorage means includes a clamp assembly structured to securely engage a facade of the skyrise.

16. A skyrise window panel installation assembly as recited in claim 1 wherein said anchorage means includes a mount bracket fixedly secured to the skyrise.

17. A skyrise window panel installation assembly as recited in claim 1 wherein said anchorage means comprises:

a scaffolding frame, said scaffolding frame including a plurality of support stanchions and a top end, said top end of said scaffolding frame being structured to extend above un upper edge of a facade of the skyrise, an extension segment secured to and extending from said top end of said scaffolding frame so as to overhang the facade of the skyrise beyond the side of the skyrise, said extension segment being further structured to engage said cable such that said cable extends downwardly along the side of the skyrise in spaced apart relation relative to the side of the building, and securing means structured to prevent said scaffolding frame from tipping towards the facade of the building.

18. A skyrise window panel installation assembly as recited in claim 17 wherein said securing means of said anchorage means includes at least one counterweight secured to said scaffolding frame.

* * * * *